United States Patent [19]

Sendzimir

[11] 4,022,073

[45] May 10, 1977

[54] ROLL DRIVE FOR CLUSTER MILLS

[76] Inventor: Tadeusz Sendzimir, P.O. Box 1350, Waterbury, Conn. 06720

[22] Filed: Nov. 12, 1975

[21] Appl. No.: 631,117

[52] U.S. Cl. ..... 74/410; 241/221; 241/230

[51] Int. Cl.[2] ..... F16H 57/00; B02C 1/08

[58] Field of Search ..... 74/410; 241/221, 227, 241/230, 234, 246

[56] References Cited

UNITED STATES PATENTS

| | | | |
|---|---|---|---|
| 2,094,106 | 9/1937 | O'Malley | 241/230 X |
| 2,549,501 | 4/1951 | McClelland | 241/221 X |
| 2,707,309 | 5/1955 | Wilson | 241/230 X |
| 3,066,876 | 12/1962 | Veroier | 241/221 X |

*Primary Examiner*—Leonard H. Gerin

*Attorney, Agent, or Firm*—Melville, Strasser, Foster & Hoffman

[57] ABSTRACT

In a beam-backed cluster-type strip mill each roll is driven separately from a vertical motor placed on top of the housing through a floating right-angle gearbox. The gearbox is keyed onto one end of each roll and is so suspended that only pure torque is transmitted to the roll and the reactions as well as the weight of the box are absorbed by the suspension means.

Roll oscillating mechanism, forcing the rolls to travel axially back and forth far enough to efface marks left by the backing casters, is incorporated in the gearbox.

This drive possesses substantial advantages over conventional drives, which make the mill more accessible, and save space. Moreover it makes possible various roll configurations by adding supplementary rolls to the cluster pattern thereby increasing the range and scope of the mill.

12 Claims, 11 Drawing Figures

ROLL DRIVE FOR CLUSTER MILLS

BRIEF SUMMARY OF THE INVENTION

In Cluster Mills, also called 6-Hi Mills, in contradistinction to so-called "Multi-roll Mills", e.g. so-called "20-Roll Mills" the drive has to be supplied to the work rolls directly, because there are no intermediate rolls between the work rolls and the backing casters. Conventional drives impose severe limitations as far as torque-transmitting capacity of such drives goes, because the spindles transmitting the torque from the pinion stand to the work rolls can obviously only have the same diameter as the work rolls and consequently the work roll necks must be much smaller.

This difficulty could be partly overcome by individually driving each work roll from its own motor, through a spindle, with the motors disposed at opposite sides of the mill. But this imposes difficulties in changing the rolls, and also is wasteful of space.

These difficulties could be solved by an individual roll drive which delivers the torque to each work roll over a pair of bevel gears from a vertical shaft coupled to a motor installed directly on the top of the mill housing. But this has posed a problem, since the slender work rolls could not bear the reaction forces from the tooth pressure of the bevel gear, nor the weight of the gearbox itself, which of course has to follow the movement of the axis of the work roll as indicated by the screwdown.

According to the present invention, a full-floating right angle gearbox is suspended from the housing through a fulcrumed and floating lever structure, preloaded to render the gearbox weightless, and thus to transmit only pure torque to the work rolls.

The present invention permits the mill to be converted instantly for the rolling of work-hardened strip which could normally not be rolled further without annealing. This is accomplished by inserting an additional roll which bears against the backing casters on one side of the mill and by adding a floating roll between the above mentioned added roll and the two work rolls, thereby to take three successive rolling passes on the strip. This roll geometry makes it possible to use the small diameter work rolls necessary for the rolling of hard materials.

The mill of the present invention can also be converted into a high production tandem mill by juxtaposing two cluster mills and adding two rolls, one above the other, and disposed in the plane of symmetry of each mill and preferably mounted in rotatable cylindrical chocks. Such a mill is self-threading in that a strip can be fed to enter the mill bite straight and after it has passed through to the winder, the chocks in both mills may be rotated simultaneously 180° right and left, thereby flexing the strip into a double S curve. In this way six consecutive passes may be achieved in one trip through the mill.

DETAILED DESCRIPTION

Pinion 12 (FIG. 3) is shown as an integral piece with its splined shaft 12' for connection with its drive motor, (not shown) by a suitable spindle. It is in mesh with the bevel gear 13, whose shaft 14 is hollow to accommodate the end of the roll 1' and is provided with a keyway 15 for the key 16, through which it transmits the torque from the drive motor to the work roll 1'.

Figure 1:
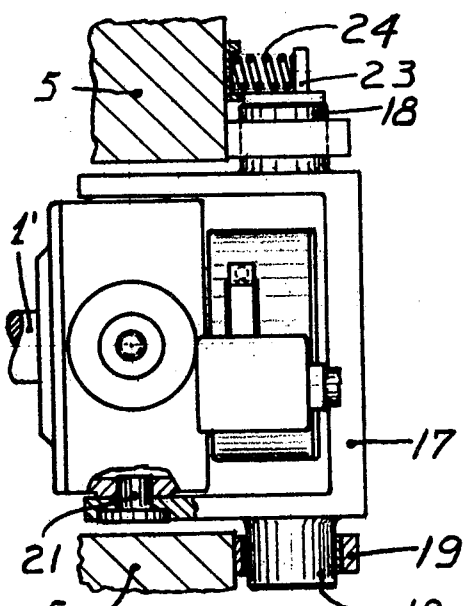
FIG. 1 is top plan view of a transmission according to the present invention.
Figure 2:
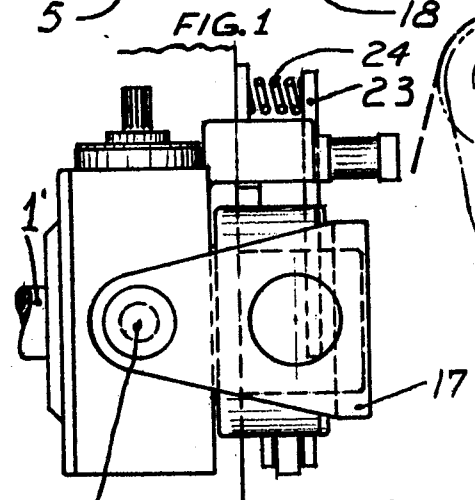
FIG. 2 is a side elevational view thereof.

Suitable bearings are provided for both shafts in the transmission box 20. Freedom of movement for the box 20 in the vertical direction, in order that it may follow the position of work roll 1', is asured by the fact that it is rotatably mounted by two pins 21 in a bracket 17. The bracket 17 is journaled by its trunnions 18 in two bearings 19 which are attached to the mill housing 5. (See FIGS. 1 and 2. )

The trunnions 18 are also free to slide axially in their bearings 19 to follow any sideways movement of the work roll 1'.

It will be noted that this suspension, besides following the position of work roll 1' freely, also absorbs the two torque reactions: (1) from the work roll, and (2) from the motor.

In order also to relieve the work roll from carrying the weight of the transmission box, a lever 23 is affixed to one of the trunnions 18. A spring 24, based against the mill housing, bears against the lever 23 to exert an easily controllable torque upon bracket 17 which in turn exerts, through the two pins 21, a suitable lifting force upon box 20, in order to annul its gravity.

This type of drive has the advantage of transmitting the torque to the work roll 1' through one or more keys, without restricting it because of the necessity of providing roll necks of smaller diameter.

This arrangement makes it possible to use the smallest work roll that the geometry of the mill will permit. In this configuration the diameter of the work roll can be much smaller than 40% of the diameter of the casters 3 (FIG. 5), which 40% is the usual limitation in cluster Mills.

In contra-distinction, conventional mill spindles require smaller work roll necks which reduce the maximum transmissible torque. This is tolerable on large diameter work rolls but would severely curtail the reducing capability of a mill with small work rolls.

Additionally, this transmission makes it possible to change the work rolls very quickly by pulling them right through the bore provided in the shaft 14.

Furthermore, this conception makes it possible to attach to the transmission box 20 a mechanism capable of subjecting the work roll to slow axial oscillations. This solves a perplexing problem which has detracted somewhat from the value of cluster and other mills using spaced casters with fixed supports between them for roll support. Such casters make the roll surface matt, while it is not similarly discolored at these places, facing said supports, where nothing touches the roll. By oscillating the rolls, depending upon their hardness and the quality of the product, say once every five minutes, by a distance even as small as half the width of a caster, those matt spots are obilterated and the whole roll assumes an even finish. As a result, the strip which the mill produces also has an even finish all the way across, rather than discolored stripes as heretofore.

This oscillation is accomplished by attaching to the work roll a screw 26 which rotates together with it and is axially connected through a nut 27 with the box 25 which is firmly bolted to the shaft 14.

By turning the nut 27 with relation to the screw 26, the roll 1' which is attached to the latter is displaced axially. That rotation is accomplished by using a modified ratchet and pawl principle. The nut 27 is connected by a key 28 to a dual saw-tooth wheel 29 rotatably mounted in the box 25.

Figures 3, 4:
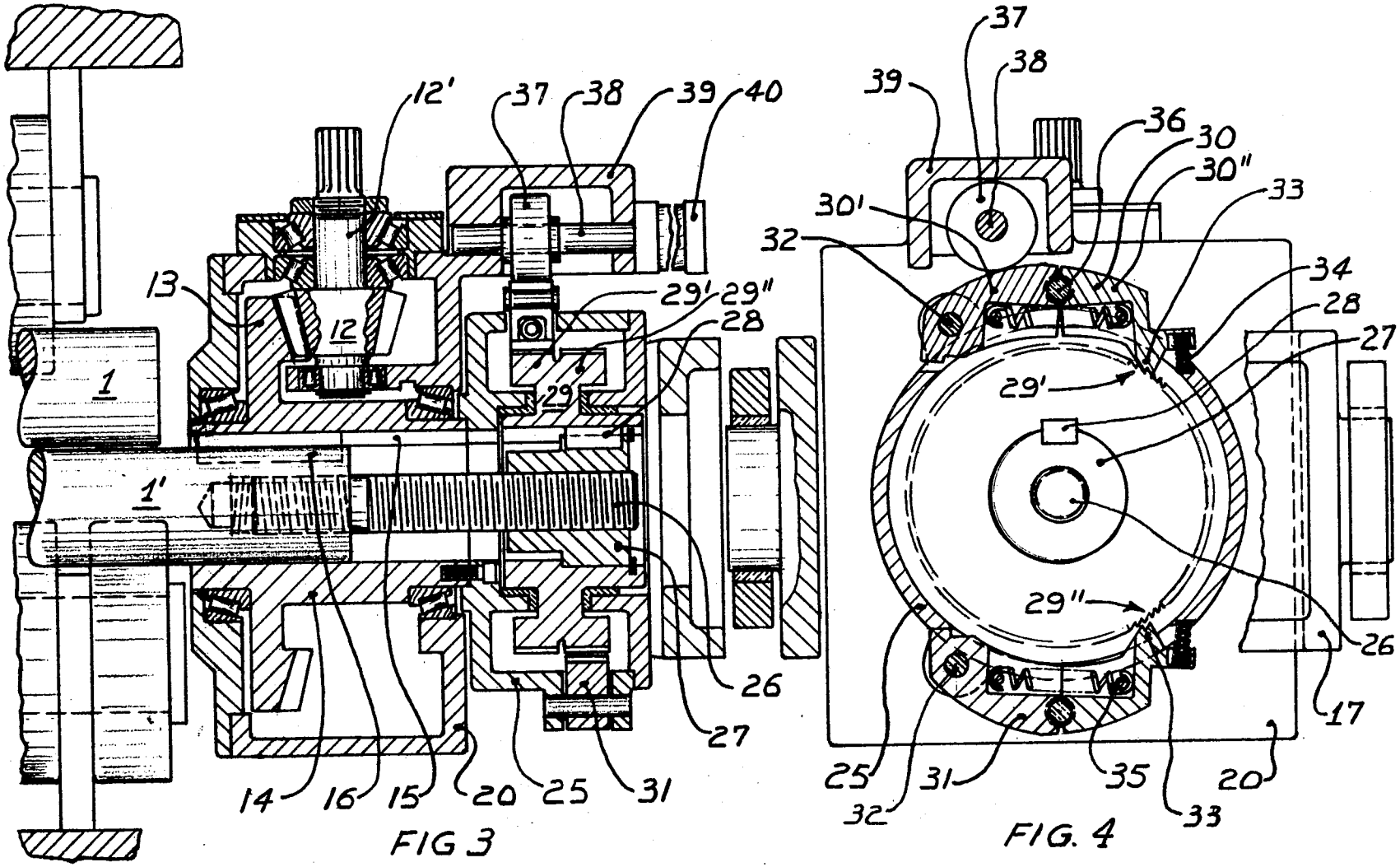
FIG. 3 is a longitudinal cross sectional view through the transmission box of FIGS. 1 and 2.
FIG. 4 is a rear elevational view with parts in section of the transmission box.

The teeth provided on the left-hand side 29' are cut in the opposite direction to the teeth provided on the right-hand side 29'' (FIG. 3).

Rotation of the wheel 29 together with the nut 27 in relation to the screw 26 is effected in one direction by one of the two knee-type pawls 30 and by the other pawl 31 in the opposite direction. Each pawl consists of two legs 30' and 30'' with a knee joint 36 therebetween and a spring 35 urging said two legs toward each other. This involves rotation around the knee joint 36, and abutment of the legs one against the other.

The pawl 31 is shown in the "closed" position in which the distance between the fulcrum pin 32 on one leg and the teeth 33 on the other leg is shortest.

The cam-shaped exterior face of the pawl 30 is engaged, once in every revolution of the work roll 1, by the roller 37 which is rotatably mounted on a shaft 38 located in a bracket 39 attached to the box 20. Such engagement causes the pawl 30 first to rotate around the fulcrum pin 32 and against the effort of the spring 34, until its teeth engage the teeth of the wheel 29'. From there on, the roller 37 causes the knee of the pawl 30 to straighten, thereby increasing the distance between the pin 32 and the teeth 33. This causes the nut 27 to rotate with respect to the screw 26 by one or more teeth, depending on the adjustment of the respective parts.

When the mill is operated as a reversing mill, and at the end of the coil the rotation of the rolls is reversed, the rotation of the wheel 29 with the nut 27 with respect to the screw 26 will continue in the same direction, irrespective of whether the work roll turns right or left.

In order to make the work roll start its axial trip in the opposite direction, the roller 37 must be shifted axially to the position where it will engage the opposite pawl 31. This can be done manually by shifting the knob 40, or by any well-known control or automatic means.

The above described drive, besides solving the problems outlined at the beginning, makes it possible to re-arrange the roll configuration of the cluster mill and thereby obtain unexpected supplementary advantages.

A beam-backed cluster mill, such as shown in U.S. Pat. No. 3,691,810, can roll a metal strip only down to a certain gauge at which it becomes too work-hardened. It must then be softened by annealing before further reduction can be accomplished. The present invention makes possible the conversion of such a mill into a dual-purpose mill, which is capable of further reducing the work-hardened strip.

Figure 5:
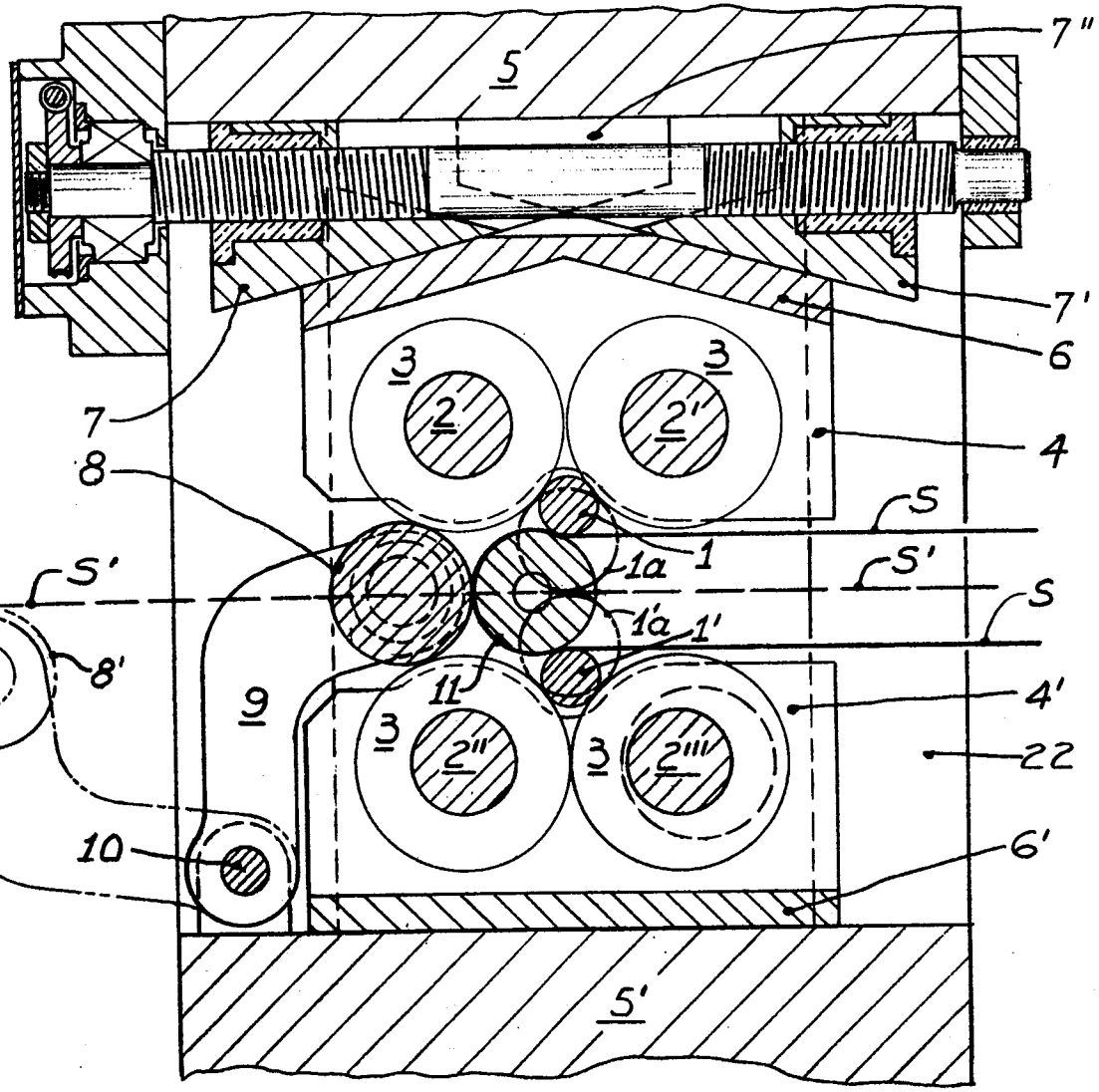
FIGS. 5, 6, 7, 10 and 11 show various roll configurations wherein rolls are added to the basic cluster (6-Hi) mill all in schematic cross section.

Referring to FIG. 5, the roughing passes are taken between the rolls 1*a* and 1'*a*. When the strip is work-hardened beyond the capability of those rolls, the mill is converted for further rolling by substituting smaller diameter rolls 1 and 1' for the rolls 1*a* and 1'*a*, inserting the central roll 11, and swinging the billy roll 8 into a position where it bears against both the upper and lower casters 3.

The exiting (upper) strand of the strip S has to be led over the top of the beam 5 of the mill housing over suitable rollers (not shown) and attached to its tension reel, by passing its billy roll 8. Taking advantage of this, a fulcrum axis 10 is provided for the levers 9 of the roll 8 at such point that the roll 8 can serve both as billy roll 8' during the roughing passes where the strip S passes over it, and between the work rolls 1*a* and 1'*a*, or as a supplementary roll 8 as hereinabove set forth.

Since the only driven rolls are the rolls 1 and 1', the three passes (between the rolls 1' and 11, between the rolls 8 and 11, and between the rolls 11 and 1) are relatively light, but the total reduction by all three is high, usually between 40% and 60%. The central roll 11 bears roll pressure from three sides: by the rolls 1, 8 and 1', and therefore a relatively large central hole can be provided in it for the purpose of cooling by fluid circulation, without risking breakage, as would be the case if pressure were applied only from two opposite sides.

Figure 6:
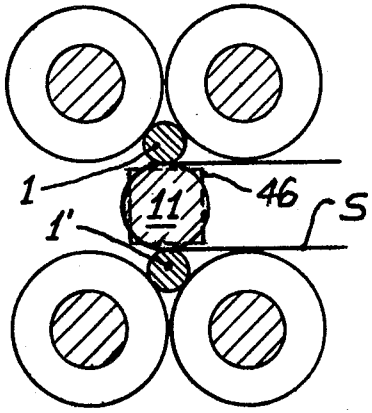

In another embodiment shown in FIG. 6, the roll 11 is located in conventional bearings, preferably disposed in chocks 46, disposed between the mill columns in the plane of symmetry of the work rolls 1, 1' for bigger freedom in the choice in the roll diameters. It should, however, have a diameter big enough in relation to its face so that it is rigid enough to support strip tension.

This configuration also requires leading the exiting strip over the top of the mill like the embodiment shown in FIG. 5, and is very suitable for rolling strips of hard materials.

Figure 7:
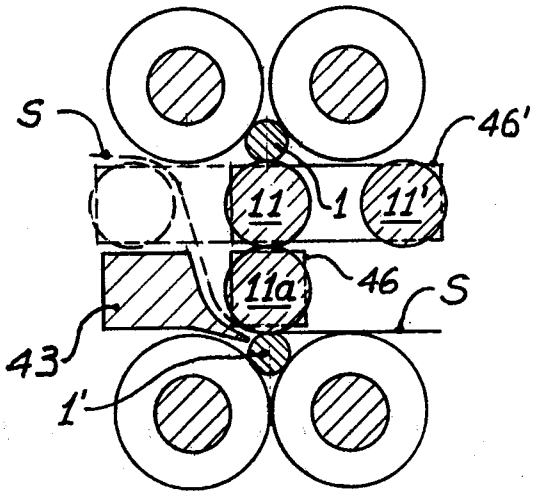

By adding another roll, 11*a* (FIG. 7), in the same plane of symmetry and leading the strip S in an s-curve, first around half the periphery of the roll 11*a* and then around roll 11, the strip undergoes three pass reductions, and exits in the same direction as it entered, without the necessity of leading it over the top of the mill.

Automatic threading of such a mill can be obtained by adding an extra roll 11' to alternate with the roll 11. The chocks 46' of both rolls are located in a common slide, the shifting of which permits either roll 11 or 11' to be in the plane of synmmetry of the mill where it is capable of taking a pass reduction on the strip. This automatic threading is accomplished in two stages:

Stage 1: The roll 11' is moved into the position formerly occupied by the roll 11, while the roll 11 is in the idle position (left) shown in broken lines. The leading end of the strip S is introduced between the work roll 1' and the roll 11*a* and the emerging leading end is deflected upward, as shown in broken lines, by the deflector 43.

Stage 2: The mill is stopped while the slide together with its rolls 11 and 11' is moved into its operating position, i.e. the roll 11' is moved into its idle position and the roll 11 into its working position. The roll 11 takes with it the protruding end of the strip S which was in its way and pulls it into the threaded position between it (roll 11) and the roll 11*a* at the bottom, and the work roll 1 at the top, thus forming a double S-curve.

Rolling is continued in this position of the rolls, and the strip S is thus subjected to three pass reductions in succession: between the rolls (1) 1' and 11*a*, (2) 11*a* and 11, (3) 11 and 1.

Figure 10:
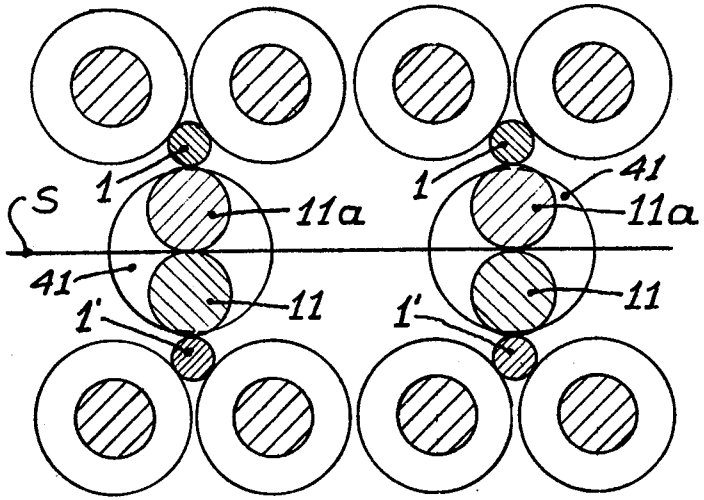
Figure 11:
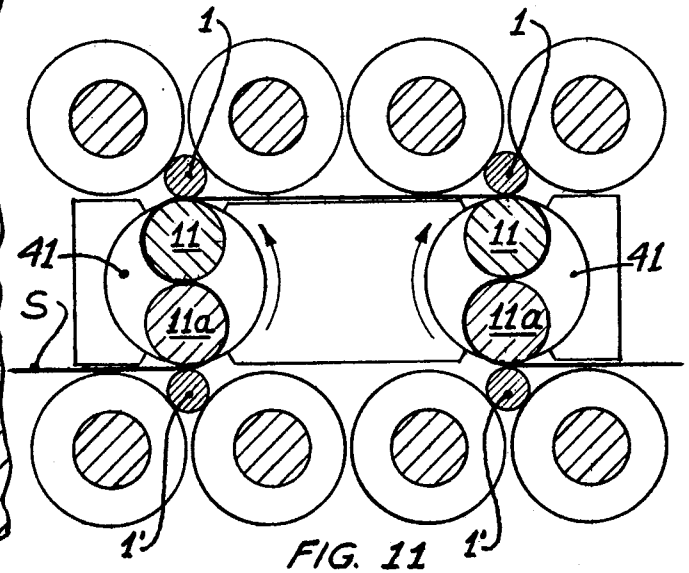
Figure 9:
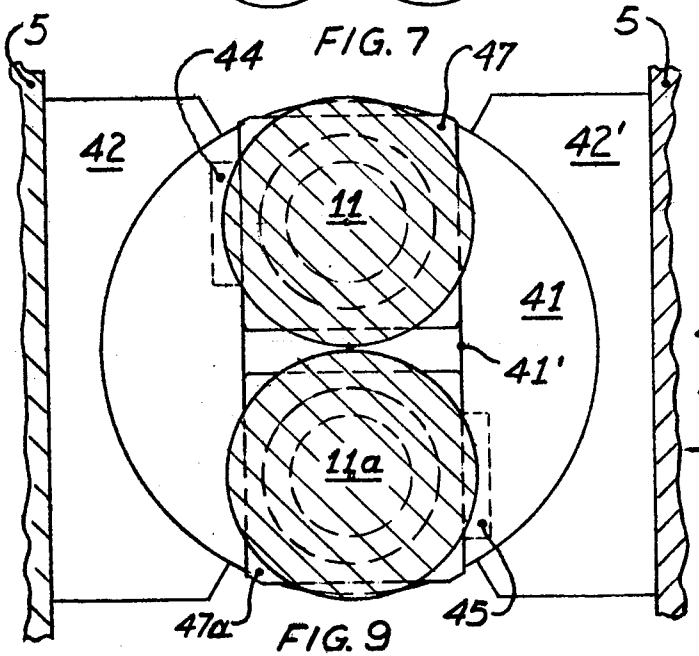
FIG. 9 is an end elevational view of FIG. 8.
Figure 8:
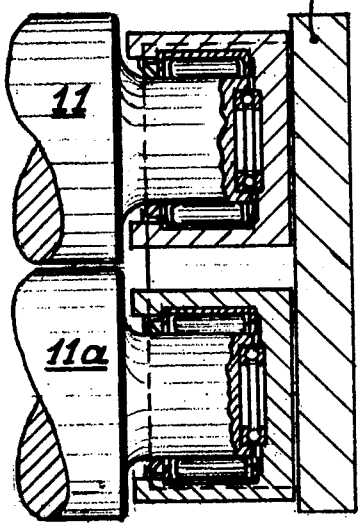
FIG. 8 is a fragmentary cross sectional view showing details of roll chocks for the roll configuration shown in FIGS. 10 and 11.

Alternately, automatic threading can be accomplished without the aid of a deflector when the chocks 47, 47*a* (FIGS. 8 and 9) of the rolls 11 and 11*a* are held in a vertical slot 41' of the rotary holder 41 to confine them to the plane of the work rolls. The holder 41 is rotatable in the arcuate cavities provided in the liners 42, 42', disposed between the holder and the mill columns 5. The strip S is introduced straight into the mill as shown in FIG. 10, which shows two such mills side by side. Thereupon the holders 41 are rotated a half turn, one to the right and one to the left, by means not shown, to the position shown in FIG. 11. Thus the mill is automatically threaded to take six consecutive passes in one operation.

Maintenance of correct tension between the respective roll bites is, as is well known in the art, essential for the rolling process. The configuration of FIG. 11 makes it possible to place load cells 44, 45, (FIG. 9) or similar pressure measuring devices directly in line with said tension for a most accurate signal, without the customary deflectors or additional apparatus.

It is to be understood that numerous modifications may be made without departing from the spirit of the invention. Therefore, no limitation, not expressly set forth, is intended, and no such limitation should be implied.

The embodiments of the invention in which an exclusive property or privilege is claimed are defined as follows:

1. A cluster mill having a housing, a pair of cooperating work rolls, each work roll supported by two parallel lines of casters, and having an end portion, a roll drive for each work roll comprising a first bevel gear keyed to the end portion of said work roll, a motor located on top of said housing and having a shaft, a second bevel gear keyed to said motor shaft and meshing with said first bevel gear, said bevel gearing mounted in a gear box attached to said housing by universal linkage, said linkage having means to absorb torque reactions of said work roll and said motor, and having means to exert upward pressure on said gear box to render it weightless.

2. A cluster mill as claimed in claim 1 wherein the diameter of the face of said work roll is not greater than the diameter of said keyed end portion.

3. A cluster mill as claimed in claim 1 wherein said universal linkage consists of a bracket fulcrumed on said housing and axially slidable to give said gear box freedom to follow the center line of the work roll.

4. A cluster mill according to claim 1 wherein said roll drive gear box incorporates a reciprocating axial travel mechanism for said roll.

5. A cluster mill according to claim 4 wherein said mechanism comprises a ratchet and a knee-type pawl having two legs with a knee-joint therebetween, for equal pawl action when either leg of said knee is depressed.

6. A cluster mill as claimed in claim 1 having two additional rolls, a large roll contacting both said lines of casters on one side of the mill and a smaller roll contacting the first named added roll and contacting also both of said work rolls, whereby three consecutive passes on a strip may be taken through all three roll bites.

7. A cluster mill according to claim 1 having two added rolls, one of said added rolls being urged against the two rows of casters on one side of the mill and the second added roll being disposed in a floating position between said first named roll and the two work rolls, whereby three consecutive passes may be taken on a strip wrapped around a portion of its periphery.

8. A cluster mill according to claim 7 having pressure means for urging said first named added roll backed by means of two parallel levers fulcrumed in the mill housing and which are reversible to swing said first added roll to a position of a billy roll.

9. A cluster mill as claimed in claim 1 in which two added rolls are mounted in chocks which locate the axes thereof in the plane of the work rolls to form three roll bites between the four rolls.

10. A cluster mill according to claim 9 wherein the chocks of the upper one of said added rolls and the chocks of a third added roll are located on one common slide and means are provided to actuate said slide to move either of said rolls into the plane of the work rolls, the position when said added roll is in the roll plane serving to roll the leading edge of the work piece and the position when the other roll on said slide is in the plane of the rolls serving to roll the remainder of said work piece, thereby facilitating threading of the mill.

11. Apparatus comprising two juxtaposed mill structures according to claim 10, the added rolls of each structure having their chocks located in common cylindrical holders, and means for rotating said cylindrical holders in parallelism and symmetrically to each other by 180°, thereby to flex the work piece introduced straight through the central roll bites into a double S curve, thereby to take six consecutive reductions.

12. The structure of claim 11 having pressure indicating apparatus mounted in cavities of the liners in which said holders are located whereby strip tension is indicated by said pressure.

* * * * *